US010185245B2

(12) United States Patent
Ueno

(10) Patent No.: US 10,185,245 B2
(45) Date of Patent: Jan. 22, 2019

(54) IMAGE FORMING APPARATUS

(71) Applicant: CANON KABUSHIKI KAISHA, Tokyo (JP)

(72) Inventor: Takashi Ueno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/640,235

(22) Filed: Jun. 30, 2017

(65) Prior Publication Data

US 2018/0017891 A1 Jan. 18, 2018

(30) Foreign Application Priority Data

Jul. 12, 2016 (JP) ..... 2016-138021

(51) Int. Cl.
*G03G 15/08* (2006.01)
*G03G 21/00* (2006.01)

(52) U.S. Cl.
CPC ..... *G03G 15/0822* (2013.01); *G03G 21/0011* (2013.01); *G03G 21/0094* (2013.01)

(58) Field of Classification Search
CPC ..... G03G 15/0822; G03G 21/00; G03G 21/0011; G03G 21/0094; G03G 21/1671; G03G 21/1828
See application file for complete search history.

(56) References Cited

U.S. PATENT DOCUMENTS 5,881,339 A * 3/1999 Yanagida ..... G03G 15/168 399/101
2011/0150512 A1* 6/2011 Tamagaki ..... G03G 21/0094 399/53
2014/0169821 A1* 6/2014 Ichinose ..... G03G 15/556 399/71
2017/0123358 A1* 5/2017 Sato ..... G03G 15/50

FOREIGN PATENT DOCUMENTS

JP H10161426 A 6/1998
JP 2011150311 A 8/2011
JP 2016018053 A 2/2016

OTHER PUBLICATIONS

Machine Translation of JPH10-161426. Jun. 19, 1998.*

* cited by examiner

*Primary Examiner* — Carla J Therrien
(74) *Attorney, Agent, or Firm* — Canon U.S.A., Inc. IP Division

(57) ABSTRACT

An image forming apparatus includes a cleaning blade that is in contact with the photoconductive member to form a nip portion and that is configured to remove an adhering substance adhering to the photoconductive member and an execution unit configured to execute a supply operation of forming a supply toner on the photoconductive member to supply the supply toner to the nip portion after completion of an image forming job of forming an image on one or a plurality of printing media in a series of operations and before the photoconductive member stops rotation. The execution unit sets the amount of supply toner such that the number of images formed at the image forming job and the amount of supply toner have a linear relationship.

13 Claims, 11 Drawing Sheets

ROTATIONAL TORQUE: LOW
TONER SUPPLY: OPTIMUM

ROTATIONAL TORQUE: LOW
TONER SUPPLY: EXCESSIVE

ROTATIONAL TORQUE: HIGH
TONER SUPPLY: A LITTLE

IMAGE FORMING APPARATUS

BACKGROUND OF THE INVENTION

Field of the Invention

The present disclosure relates to image forming apparatuses using an electrophotographic method or an electrostatic recording method, such as copying machines, printers, and facsimiles.

Description of the Related Art

For example, in image forming apparatuses using an electrophotographic method in the related art, a toner image formed on an image bearing member, such as a photoconductive member, is transferred and fixed to a printing medium to form an image. In such image forming apparatuses, residual toner and other adhering substances on the surface of an image bearing member after a transferring process are removed with a cleaning unit. A widely used example of the cleaning unit is an elastic cleaning blade serving as a cleaning member that is disposed in contact with the image bearing member and that scrapes the toner and so on from the image bearing member.

The cleaning blade is generally disposed in contact with the image bearing member in a direction counter to the direction of rotation of the image bearing member, and therefore the friction between the image bearing member and the cleaning blade can be excessive. The excessive friction may cause the cleaning blade to be worn, to vibrate to generate an unusual noise, to be curled up, or another malfunction.

Japanese Patent Laid-Open No. 10-161426 discloses a technique for preventing generation of an unusual noise halfway through stopping the image bearing member by forming a predetermined toner image on the image bearing member and supplying the toner of the toner image to a contact portion between the image bearing member and the cleaning blade halfway through stopping the image bearing member after completion of image formation.

The above method can reduce the friction between the image bearing member and the cleaning blade halfway through stopping the image bearing member after completion of image formation. However, in the case where a fixed amount of toner is supplied to the contact portion between the image bearing member and the cleaning blade after completion of image formation, the toner can run short to generate excessive friction or, on the contrary, the toner is too much and wasted at the next start of the image bearing member.

SUMMARY OF THE INVENTION

An image forming apparatus according to a first aspect of the present disclosure includes a rotatable photoconductive member on which an electrostatic image is formed based on an image signal, a developing unit, a cleaning blade, and an execution unit. The developing unit is configured to apply toner to the electrostatic image formed on the photoconductive member. The cleaning blade is in contact with the photoconductive member to form a nip portion and is configured to remove an adhering substance adhering to the photoconductive member as the photoconductive member moves. The execution unit is configured to execute a supply operation of forming a supply toner on the photoconductive member to supply the supply toner to the nip portion after completion of an image forming job of forming an image on one or a plurality of printing media in a series of operations and before the photoconductive member stops rotation. The execution unit sets the amount of supply toner such that the number of images formed at the image forming job and the amount of supply toner have a linear relationship.

An image forming apparatus according to a second aspect of the present disclosure includes a rotatable photoconductive member on which an electrostatic image is formed based on an image signal, a developing unit, a cleaning blade, and an execution unit. The developing unit is configured to apply toner to the electrostatic image formed on the photoconductive member. The cleaning blade is in contact with the photoconductive member to form a nip portion and is configured to remove an adhering substance adhering to the photoconductive member as the photoconductive member moves. The execution unit is configured to execute a supply operation of forming a supply toner on the photoconductive member to supply the supply toner to the nip portion after completion of an image forming job of forming an image on one or a plurality of printing media in a series of operations and before the photoconductive member stops rotation. The execution unit sets the amount of supply toner such that the number of images formed at the image forming job and the amount of supply toner have a stepwise relationship.

Further features of the present invention will become apparent from the following description of exemplary embodiments with reference to the attached drawings.

DESCRIPTION OF THE EMBODIMENTS

An image forming apparatus according to some embodiments of the present disclosure will be described in detail below with reference to the drawings.

First Embodiment

1. Overall Configuration and Operation of Image Forming Apparatus

Figure 1:
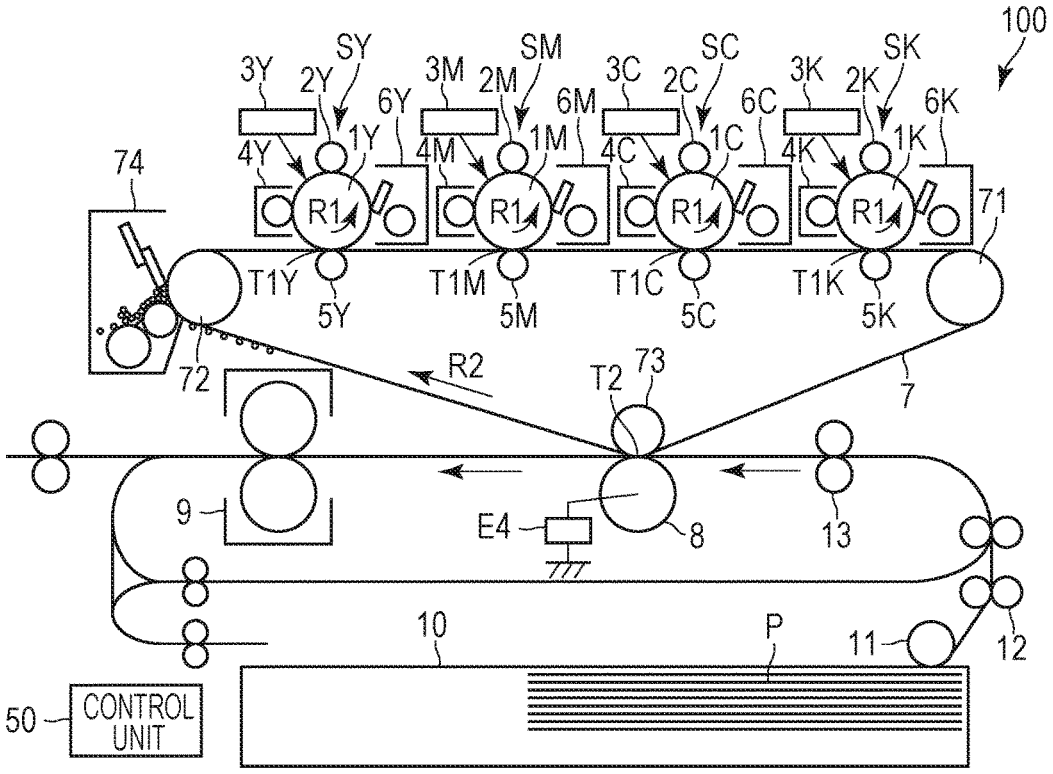
FIG. 1 is a cross-sectional view illustrating, in outline, the configuration of an image forming apparatus according to a first embodiment.

FIG. 1 is a cross-sectional view illustrating, in outline, the configuration of an image forming apparatus 100 according to a first embodiment. The image forming apparatus 100 of the present embodiment is a tandem printer that employs an intermediate transfer method and that is capable of forming a full-color image using an electrophotographic method.

Figure 2A:
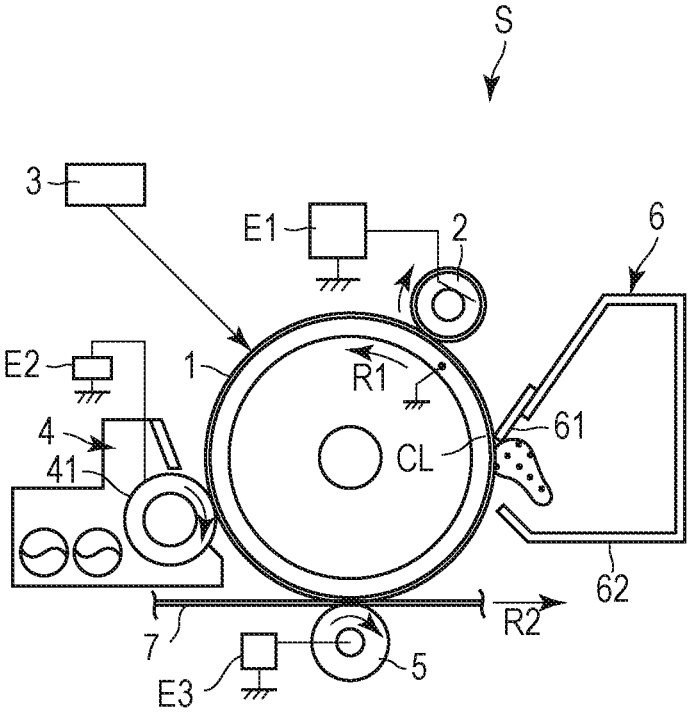
FIG. 2A is a cross-sectional view illustrating, in outline, an image forming unit.

The image forming apparatus 100 includes, as a plurality of image forming units (stations), first, second, third, and fourth image forming units SY, SM, SC, and SK that respectively form yellow (Y), magenta (M), cyan (C), and black (K) color images. Components having the same or corresponding functions or configurations of these four image forming units SY, SM, SC, and SK are sometimes described comprehensively by omitting the last signs Y, M, C, and K indicating the respective colors. In the present embodiment, an image forming unit S includes a photoconductive drum 1, a charge roller 2, an exposure unit 3, a primary transfer roller 5, a drum cleaning unit 6, and so on, which will be described below. FIG. 2A is a cross-sectional view illustrating, in outline, the image forming unit S.

The photoconductive drum 1, which is a drum-shaped photoconductive member serving as a first image bearing member that bears a toner image, is rotatably driven in the direction of arrow R1 (counterclockwise) in the drawing at a predetermined circumferential speed (process speed) by a drum driving motor M1 (FIG. 6), which is a driving unit. The surface of the rotating photoconductive drum 1 is uniformly charged to a predetermined potential of a predetermined polarity (a negative polarity in the present embodiment) by the charge roller 2 serving as a charger. At the charging process, a charging voltage (a charging bias), which is an oscillating voltage in which an alternating-current voltage is superposed on a direct-current voltage of a negative polarity, is applied to the charge roller 2 from a charging power source E1. The surface of the charged photoconductive drum 1 is scanning-exposed by the exposure unit 3 according to image information to form an electrostatic latent image (electrostatic image) on the photoconductive drum 1. In the present embodiment, the exposure unit 3 is a laser scanner that scans a laser beam with a wavelength of $\lambda$=780 nm for exposure. The exposure unit 3 scans a laser beam subjected to on-off keying based on scanning-line image data, in which separated color images corresponding to the individual image forming units S are developed, using a revolving mirror to form an electrostatic latent image of the image on the surface of the charged photoconductive drum 1. The exposure unit 3 may be a laser scanner as in the present embodiment, a digital exposure unit, such as an LED array, or an analog exposure unit that projection-exposes an original image for imaging.

The electrostatic latent image formed on the photoconductive drum 1 is developed (visualized) with a toner (a developer) supplied from a developing unit 4, so that a toner image is formed on the photoconductive drum 1. In the present embodiment, the developing unit 4 uses a two-component developer in which a toner (non-magnetic toner particles) and a carrier (magnetic carrier particles) are mixed. The developing unit 4 includes as a developer bearing member a developing sleeve 41 in which a magnet roller is fixed in the hollow. The developing unit 4 stirs and conveys the two-component developer and charges the toner to a negative polarity and the carrier to a positive polarity. The carrier to which the charged toner adheres is born on the developing sleeve 41 due to a magnetic field generated from the magnet roller and is conveyed to a portion (a developing portion) facing the photoconductive drum 1. The two-component developer frictionally slides the photoconductive drum 1 in a locally protruding state at the developing portion. At the developing process, a developing voltage (developing bias), which is an oscillating voltage in which an alternating-current voltage is superposed on a direct-current voltage of a negative polarity, is applied to the developing sleeve 41 from a developing power source E2. This causes the toner to be transferred to an image portion of the electrostatic latent image on the photoconductive drum 1, which becomes positive relative to the developing sleeve 41. In other words, in the present embodiment, the toner charged to the same polarity as the charge polarity of the photoconductive drum 1 adheres to the exposed portion on the photoconductive drum 1, in which the absolute value of the potential is decreased due to exposure after the photoconductive drum 1 is uniformly charged, (reversal development). The developing unit 4 is one example of a supply unit that supplies toner to the image bearing member.

An intermediate transfer belt 7, which is an intermediate transfer member formed of an endless belt serving as a second image bearing member for bearing a toner image, is disposed so as to face each photoconductive drum 1 of each image forming unit S. The intermediate transfer belt 7 is stretched round a plurality of tension rollers, that is, a driving roller 71, a tension roller 72, and a secondary-transfer facing roller 73, by a predetermined tensile force. The intermediate transfer belt 7 rotates (circumferentially moves) in the direction of arrow R2 (clockwise) in the drawing at the same circumferential speed as the circumferential speed of the photoconductive drum 1 because the driving roller 71 is rotationally driven by a belt drive motor M2 (FIG. 6) serving as a driving unit. The primary transfer roller 5 serving as a primary transfer unit is disposed on the inner circumferential surface of the intermediate transfer belt 7 in correspondence with each photoconductive drum 1. The primary transfer roller 5 is pushed to the photoconductive drum 1 with the intermediate transfer belt 7 therebetween to form a primary transfer portion (a primary transfer nip) T1 at which the photoconductive drum 1 and the intermediate transfer belt 7 come into contact with each other. The toner image formed on the photoconductive drum 1, as described above, is transferred (primarily transferred) onto the rotating intermediate transfer belt 7 at the primary transfer portion T1. At the primary transfer process, a primary transfer voltage (primary transfer bias), which is a direct-current voltage of a polarity opposite to the charge polarity or the toner at development (regular charge polarity) is applied from a primary transfer power source E3. For example, in forming a full-color image, yellow, magenta, cyan, and black color toner images formed on the individual photoconductive drums 1 are sequentially transferred onto the intermediate transfer belt 7 so as to be superposed on one another.

A secondary transfer roller 8 which is a secondary transfer member is disposed at a position on the outer circumferential surface of the intermediate transfer belt 7 facing the secondary-transfer facing roller 73. The secondary transfer roller 8 is pushed to the secondary-transfer facing roller 73, with the intermediate transfer belt 7 therebetween, to form a secondary transfer portion (a secondary transfer nip) T2 at which the intermediate transfer belt 7 and the secondary transfer roller 8 come into contact with each other. The toner image formed on the intermediate transfer belt 7 as described above is transferred to a printing medium P, such as paper, conveyed between the intermediate transfer belt 7 and the secondary transfer roller 8 at the secondary transfer portion T2 (secondary transfer). At the secondary transfer process, a secondary transfer voltage (secondary transfer bias), which is a direct-current voltage having a polarity opposite to the regular charge polarity of the toner, is applied to the secondary transfer roller 8 from a secondary-transfer power source E4. The printing media P are stored in a cassette 10 serving as a printing medium container and are fed out from the cassette 10 by a pick-up roller 11, are separated one by one by a separation roller pair 12, and are conveyed to a registration roller pair 13. The printing media P are supplied to the secondary transfer portion T2 by the registration roller pair 13 at synchronous timing with the toner image on the intermediate transfer belt 7.

Each printing medium P on which the toner image is transferred is conveyed to a fixing unit 9, where the printing medium P is heated and pressed so that the toner image is fixed (firmly fixed by melting) and is thereafter discharged (output) from the apparatus main body of the image forming apparatus 100.

Adhering substances, such as a toner (a primary-transfer residual toner) remaining on the photoconductive drum 1, after the primary transfer process is removed from the surface of the photoconductive drum 1 by the drum cleaning unit 6, which is a photoconductive-member cleaning unit, for recovery. Adhering substances, such as a toner (a secondary-transfer residual toner) remaining on the intermediate transfer belt 7, after the secondary transfer process is removed from the surface of the intermediate transfer belt 7 by a belt cleaning unit 74, which is an intermediate-transfer-member cleaning unit, for recovery.

Figure 6:
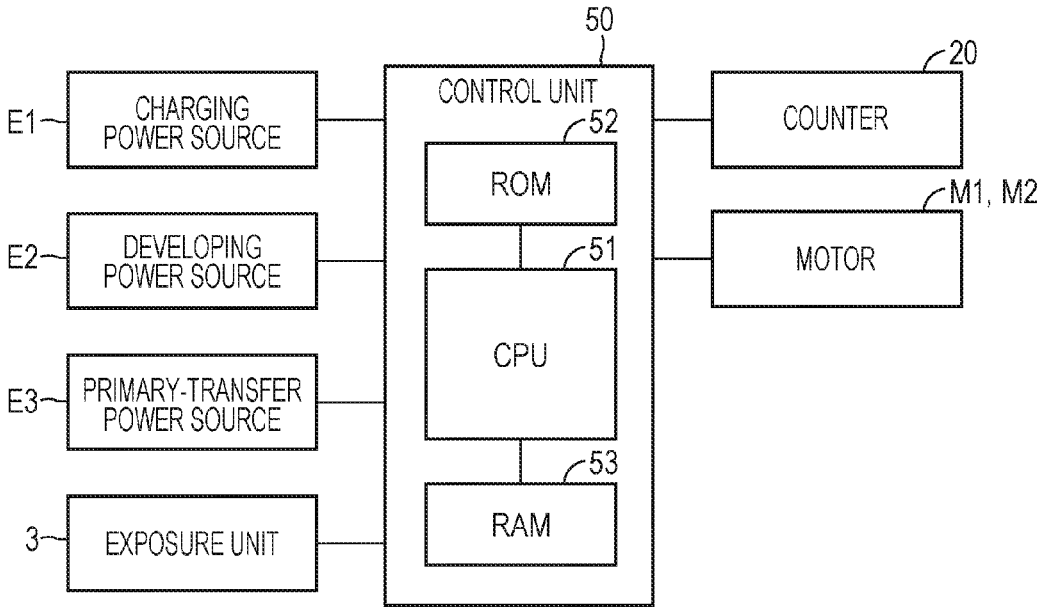
FIG. 6 is a block diagram illustrating, in outline, the control configuration of the principal components of the image forming apparatus.

FIG. 6 is a block diagram illustrating, in outline, the control configuration of the principal components of the image forming apparatus 100 of the present embodiment. In the present embodiment, the operations of the components of the image forming apparatus 100 are controlled in a centralized manner by a control unit 50 provided in the apparatus main body of the image forming apparatus 100. The control unit 50 includes a central processing unit (CPU) 51 serving as an operation control unit, a read-only memory (ROM) 52, a random-access memory (RAM) 53 which serve as storage units, and so on. The CPU 51 causes the components to execute the image forming operation and a supply operation, described later, according to programs stored in the ROM 52 using the RAM 53 as a work area as appropriate.

The image forming apparatus 100 executes a series of operations (a job, an image output operation) for forming an image on one or a plurality of printing media P, which is started according to a start instruction. The job generally includes an image forming process, a pre-rotation process, an inter-sheet process in the case of forming images on a plurality of printing media P, and a post-rotation process. The image forming process is a process of forming an electrostatic latent image of an image to be actually formed on the printing medium P and output, forming a toner image, primarily transferring the toner image, and secondarily transferring the toner image. An image forming period is the period of the image forming process. More specifically, the timing of image formation differs among the positions of forming an electrostatic latent image, forming a toner image, primarily transferring the toner image, and secondarily transferring the toner image. The pre-rotation process is a process of preparing for the image forming process after a start instruction is input until image formation is actually started. The inter-sheet process is a process corresponding to the interval between a printing medium P and a printing medium P in the case where image formation is continuously performed on a plurality of printing media P (continuous image formation). The post-rotation process is a process of finishing (preparation) after the image forming process. A no-image-forming period is a period other than the image forming period and includes the periods of the pre-rotation process, the inter-sheet process, the post-rotation process, and a pre-multi-rotation process, which is a preparatory operation at the power-up of the image forming apparatus 100 or resuming from a sleep mode.

2. Photoconductive Drum

Figure 2B:
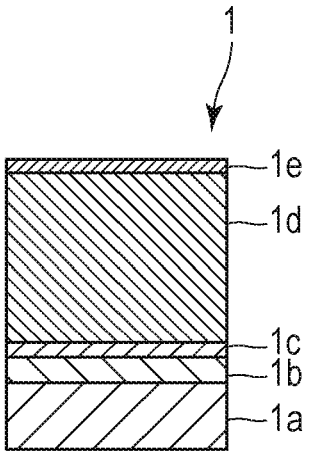
FIG. 2B is a schematic cross-sectional view of the layer configuration of a photoconductive drum.

FIG. 2B is a schematic cross-sectional view of the layer configuration of the photoconductive drum 1 in the present embodiment. The photoconductive drum 1 includes a laminated (function-separation type) organic photoconductor (OPC) layer in which a charge generation layer 1*c* containing a charge generating substance and a charge transport layer 1*d* containing a charge transporting substance are layered in sequence on an electrically conductive base 1*a*. In the present embodiment, the electrically conductive base 1*a* is an aluminum cylinder, on the outer circumferential surface of which the photoconductor layer is formed. In the present embodiment, an undercoating layer 1*b* having a barrier function and a bonding function is disposed on the electrically conductive base 1*a* and under the photoconductive layer. The undercoating layer 1*b* is disposed to improve the adhesion and coating performance of the photoconductive layer, to protect the electrically conductive base 1*a*, to coat the protrusions and depressions of the electrically conductive base 1*a*, to improve the performance of charge injection from the electrically conductive base 1*a*, to protect the photoconductive layer from electrical breakdown, and so on. In the present embodiment, a surface protection layer 1*e* is provided on the photoconductive layer. The surface of the photoconductive drum 1 is polished using a polishing tape (wrapping paper), buffed, or the like to have a ten-point medium height Rz (JIS B 0601-1982) of 0.2 to 2 μm.

3. Developer

In the present embodiment, a two-component developer in which a carrier and toner are mixed at a weight ratio of 91:9 (toner concentration: 9%) is used as the developer. The total weight of the developer contained in the developing unit 4 at the beginning is 350 g.

In the present embodiment, ferrite particles coated with silicone resin is used as a carrier. The saturation magnetization of the carrier for an applied magnetic field of 240 [kA/m] is 24 [$Am^2$/kg]. The specific resistance of the carrier at a field intensity of 3,000 [V/cm] is $1\times10^7$[Ω·cm] to $1\times10^8$[Ω·cm], and the weight-average particle diameter is 50 μm.

The toner contains at least a binder, a coloring agent, and a charging control agent. In the present embodiment, a styrene-acrylic resin is used as the binder resin. Other examples of the binder resin can include styrene resins, polyester resins, and polyethylene resins. The coloring agent may be one or a combination of a plurality of coloring agents including various pigments and dyes. The charging control agent may contain a charge control agent for reinforcement as necessary. Examples of the charge control agent for reinforcement include nigrosine dyes and triphenylmethane dyes. In the present embodiment, the weight-average particle diameter of the toner is 5.7 μm. In the present embodiment, the toner contains wax. The wax is contained to enhance the releasability from a fixing member and fixing performance. Examples of the wax include a paraffin wax, a carnauba wax, and polyolefin. The wax is kneaded and dispersed into the binder resin for use. The present embodiment uses as the toner a resin obtained by kneading and dispersing a binder, a coloring agent, a charge control agent, and wax and grinding it with a mechanical grinder. In the present embodiment, the toner contains and external additive. Examples of the external additive include amorphous silica subjected to hydrophobic treatment and inorganic oxide fine particles, such as titanium oxide and titanium compounds. Such fine particles are added to the toner to adjust the particle flow property and the amount of charge of the toner. The particle diameter of the external additive particles is preferably 1 nm or larger and 100 nm or less. In the present embodiment, titanium oxide having an average particle diameter of 50 nm is added at a weight ratio of 0.5 wt % to the toner, and amorphous silica having average particle diameters 2 nm and 100 nm are added to the toner at weight ratios of 0.5 wt % and 1.0 wt %, respectively, as external additives.

4. Drum Cleaning Unit

The drum cleaning unit 6 includes a cleaning blade 61 and a cleaning container 62 to which the cleaning blade 61 is attached. The cleaning blade 61 is an example of a cleaning member that is disposed in contact with the image bearing member to clean the image bearing member. The cleaning blade 61 is a plate-like (blade-like) member made of an elastic material (urethane rubber in the present embodiment) having a predetermined thickness. The cleaning blade 61 is disposed such that the longitudinal direction thereof is substantially parallel to the longitudinal direction (the direction of the axis of rotation) of the photoconductive drum 1 and that an end (free end) in the crosswise direction is in contact with the surface of the photoconductive drum 1 in a counter direction in which the free end is directed upstream of the direction of rotation of the photoconductive drum 1. More specifically, the cleaning blade 61 is in contact with the surface of the photoconductive drum 1 at the edge of the free end near the photoconductive drum 1. The cleaning blade 61 is longer in the longitudinal direction than an image forming region (a region in which a toner image can be formed) in the longitudinal direction of the photoconductive drum 1, so that the image forming region is within the length of the cleaning blade 61.

The cleaning blade 61 frictionally slides on the surface of the photoconductive drum 1 to scrape adhering substances, such as a primary-transfer residual toner, adhering to the surface of the photoconductive drum 1 from the surface of the photoconductive drum 1 and stores the adhering substances in the cleaning container 62. In other words, in the primary transfer process at the primary transfer portion T1, not all of the toner constituting the toner image on the photoconductive drum 1 is not transferred to the intermediate transfer belt 7, but a little primary-transfer residual toner remains on the photoconductive drum 1 that has passed through the primary transfer portion T1. This primary-transfer residual toner is conveyed to a contact portion (also referred to as "cleaning portion") CL between the photoconductive drum 1 and the cleaning blade 61 with the rotation of the photoconductive drum 1 and is removed from the surface of the photoconductive drum 1 by the cleaning blade 61 for recovery.

In the present embodiment, the belt cleaning unit 74 also has a configuration similar to the configuration of the drum cleaning unit 6. In other words, the belt cleaning unit 74 removes adhering substances, such as a secondary-transfer residual toner, from the surface of the rotating intermediate transfer belt 7 with a cleaning blade disposed in contact with the intermediate transfer belt 7 and recovers it.

5. Posture of Cleaning Blade

Figure 3:
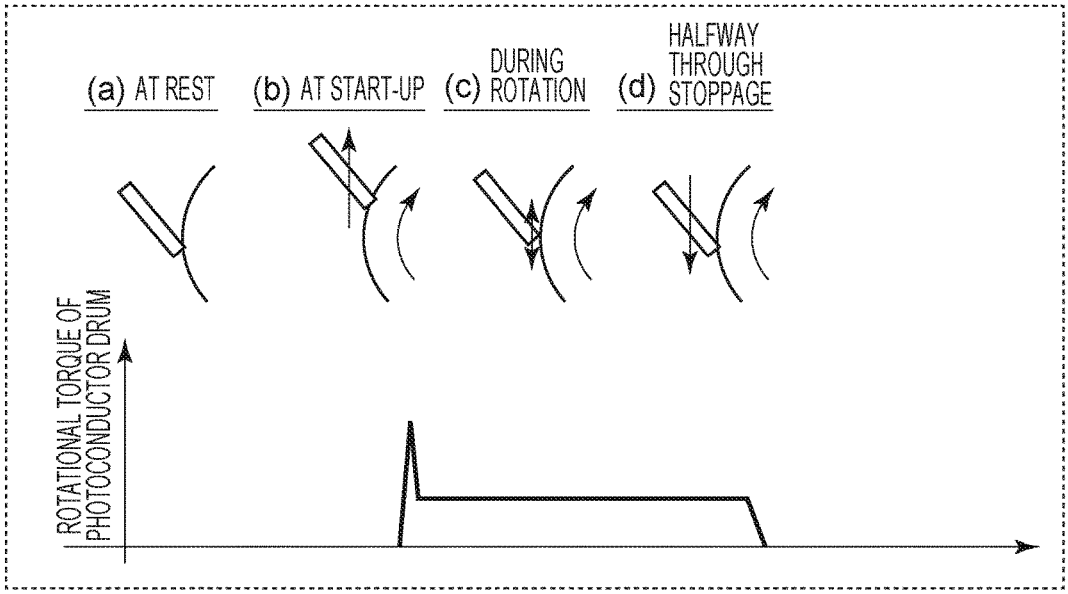
FIG. 3 is a schematic diagram illustrating the rotational torque of the photoconductive drum.

FIG. 3 is a schematic diagram illustrating the relationship among the state of the driving of the photoconductive drum 1, the posture of the cleaning blade 61, and the rotational torque of the photoconductive drum 1 indicating the friction between the photoconductive drum 1 and the cleaning blade 61.

As illustrated in FIG. 3(*a*), while the photoconductive drum 1 is at rest (standstill), the rotational torque of the photoconductive drum 1 is 0. As illustrated in FIG. 3(*b*), when the photoconductive drum 1 is started, the friction between the photoconductive drum 1 and the cleaning blade 61 increases instantaneously. This causes the cleaning blade 61 to move in the same direction as the direction of rotation of the photoconductive drum 1 and increases the rotational torque of the photoconductive drum 1.

Thereafter, as illustrated in FIG. 3(*c*), the friction between the photoconductive drum 1 and the cleaning blade 61 is low while the photoconductive drum 1 is rotating, so that the cleaning blade 61 is held in equilibrium at an upper stream position in the direction of rotation of the photoconductive drum 1 than that in FIG. 3(*b*). If, for example, discharge from the charge roller 2 or the primary transfer roller 5 or drying-up of toner which acts as a lubricant at the edge of the cleaning blade 61 occurs at that time, the friction between the photoconductive drum 1 and the cleaning blade 61 increases. This can cause the cleaning blade 61 to gradually move downstream in the direction of rotation of the photoconductive drum 1 from the position in FIG. 3(*c*) to gradually increase the rotational torque of the photoconductive drum 61. Finally, this can cause a malfunction such as curling of the cleaning blade 61. However, since a primary-transfer residual toner is generally supplied to the cleaning portion CL during image formation, the friction between the photoconductive drum 1 and the cleaning blade 61 is held moderately low, preventing the malfunction of the cleaning blade 61. Furthermore, as described later, a predetermined toner image may be formed on the photoconductive drum 1 at the inter-sheet process during continuous image formation, and the toner of the toner image may be supplied to the cleaning portion CL.

As illustrated in FIG. 3(*d*), when the photoconductive drum 1 stops (halfway through stoppage) after completion of image formation, the position of the cleaning blade 61 returns to substantially the same position as the start-up position of the photoconductive drum 1 due to the elastic force of the cleaning blade 61.

Thus, the rotational torque of the photoconductive drum 1 is the maximum, and the amount of movement of the cleaning blade 61 in the direction of rotation of the photoconductive drum 1 is the maximum at the start-up of the photoconductive drum 1.

As described above, there is a method for preventing generation of abnormal noise halfway through stopping the photoconductive drum 1 by forming a predetermined toner image on the photoconductive drum 1 halfway through stopping the photoconductive drum 1 after completion of image formation and supplying the toner of the toner image to the cleaning portion CL.

When toner is supplied to the cleaning portion CL during post rotation, the toner is held at the cleaning portion CL while the photoconductive drum 1 is at rest (standstill). More specifically, the toner is held between the end face of the free end of the cleaning blade 61 and the surface of the photoconductive drum 1 or between the edge of the cleaning blade 61 and the surface of the photoconductive drum 1 as the toner enters little by little. This toner (or its external additive) acts as a lubricant for reducing the friction between the photoconductive drum 1 and the cleaning blade 61. However, if a fixed amount of toner is supplied to the cleaning portion CL during post rotation, as in the related art, the toner held at the cleaning portion CL can be lacking at the start-up of the photoconductive drum 1 during which the rotational torque of the photoconductive drum 1 is high. This can increase the rotational torque of the photoconductive drum 1, causing malfunctions in the cleaning blade 61, such as wear, vibration to generate abnormal noise, or curling of the cleaning blade 61. In contrast, if a fixed amount of toner is supplied to the cleaning portion CL during post rotation, as in the related art, the amount of toner held at the cleaning portion CL at the start-up of the photoconductive drum 1 can become larger than is necessary. In such a case, the rotational torque of the photoconductive drum 1 at the start-up of the photoconductive drum 1 will be reduced, but the toner will be wastefully consumed.

Figure 4A:
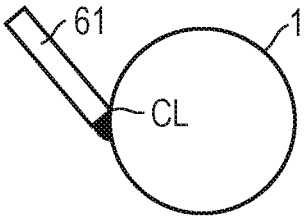
FIGS. 4A to 4C are schematic diagrams illustrating the difference in the rotational torque at the start-up of the photoconductive drum.
Figure 4B:
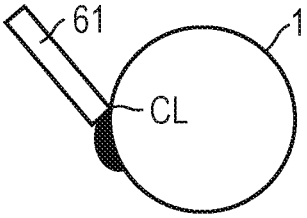
Figure 4C:
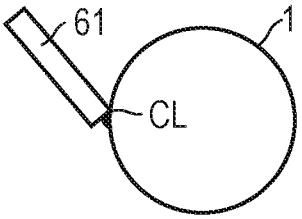

FIGS. 4A to 4C are schematic diagrams illustrating the state of the cleaning portion CL at the start-up of the photoconductive drum 1 (before image formation). FIG. 4A illustrates a state in which a sufficient amount of toner for preventing the malfunction of the cleaning blade 61 at the start-up of the photoconductive drum 1 is held at the cleaning portion CL. In contrast, if an excessive amount of toner is held at the cleaning portion CL, as illustrated in FIG. 4B, no malfunction occurs in the cleaning blade 61, but the toner is wastefully consumed. If only a smaller amount of toner is held at the cleaning portion CL than that in the case of FIG. 4A, as illustrated in FIG. 4C, the rotation load at the start-up of the photoconductive drum 1 becomes excessive, increasing the possibility of malfunction of the cleaning blade 61.

Figure 5A:
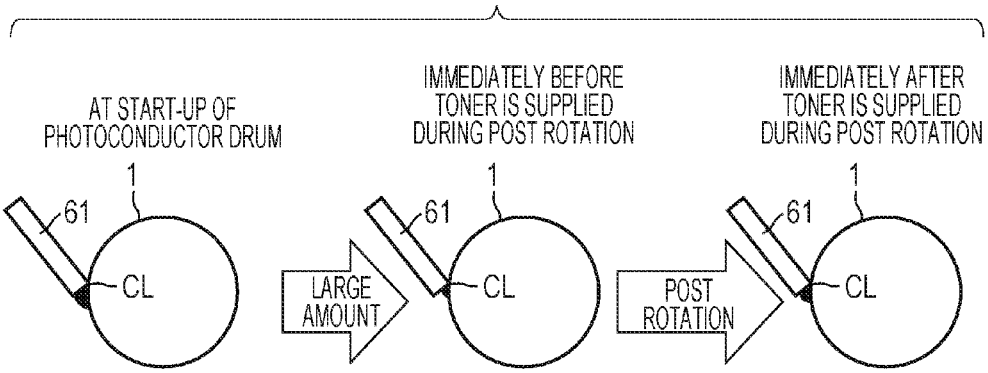
FIG. 5A is a schematic diagram illustrating the amount of toner held at a cleaning portion.
Figure 5B:
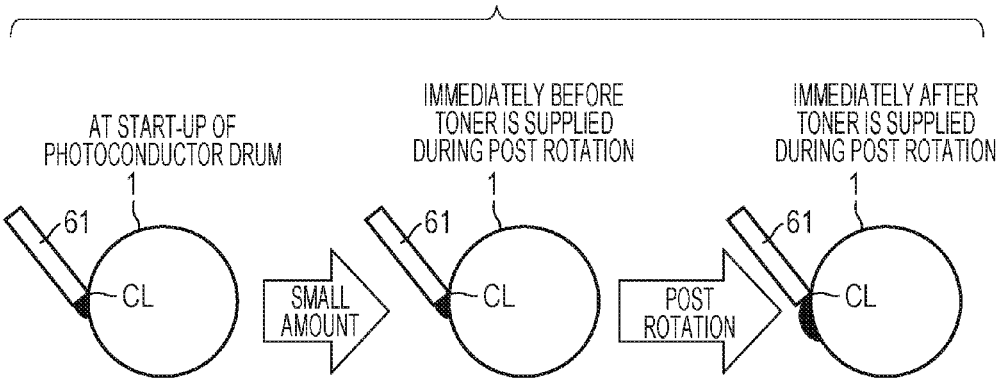
FIG. 5B is a schematic diagram illustrating the amount of toner held at a cleaning portion.

Referring next to FIGS. 5A and 5B, the states of toner held at the cleaning portion CL before image formation, after image formation, and after post rotation will be described. FIGS. 5A and 5B illustrate cases where image formation is performed under different conditions from a state in which a proper amount of toner is held at the cleaning portion CL, as illustrated in FIG. 4A, and a fixed amount of toner is supplied to the cleaning portion CL during post rotation.

As illustrated in FIGS. 5A and 5B, the amount of toner held at the cleaning portion CL at the start-up of the photoconductive drum 1 increases or decreases depending on the condition of image formation, so that the rotational torque of the photoconductive drum 1 decreases or increases. In other words, if a fixed amount of toner is supplied to the cleaning portion CL during post rotation, the rotational torque at the start-up of the photoconductive drum 1 at the next image formation varies depending on the condition of image formation before the photoconductive drum 1 is stopped.

For example, when a large amount of images that consume a little toner per A4 size are formed, little toner may be supplied to the cleaning portion CL during continuous image formation. Furthermore, the toner held at the cleaning portion CL can drop downward during the continuous image formation. In that case, the amount of toner held at the cleaning portion CL immediately before toner is supplied to the cleaning portion CL during post rotation becomes smaller than the amount of toner held at the start-up of the photoconductive drum 1, as illustrated in FIG. 5A. If a fixed amount of toner is supplied to the cleaning portion CL during post rotation, the amount of toner held at the cleaning portion CL becomes smaller than the amount of toner held at the start-up of the photoconductive drum 1. This increases the rotational torque of the photoconductive drum 1 at the start-up of the photoconductive drum 1 for the next image formation.

In contrast, a small amount of images that consume much toner per A4 size are formed, much primary-transfer residual toner may be supplied to the cleaning portion CL during image formation (for example, during continuous image formation). In that case, the amount of toner held at the cleaning portion CL immediately before toner is supplied to the cleaning portion CL during post rotation hardly decrease from the amount of toner held at the start-up of the photoconductive drum 1, as illustrated in FIG. 5B. If a fixed amount of toner is supplied to the cleaning portion CL during post rotation in that state, the amount of toner held at the cleaning portion CL thereafter becomes larger than the amount of toner held at the start-up of the photoconductive drum 1. Thus, more than necessary amount of toner is held at the cleaning portion CL, increasing wasteful toner.

6. Supply Operation in Present Embodiment

In the present embodiment, the control unit 50 can cause the image forming apparatus 100 to execute a supply operation of forming a predetermined toner image on the photoconductive drum 1 and supplying the toner of the toner image to the cleaning portion CL during post rotation after completion of image formation of the job. In the present embodiment, the predetermined toner image is a belt-like toner image (also referred to as "toner band") whose length in a direction substantially perpendicular to the conveying direction (longitudinal direction) extends across the entire image forming region in the longitudinal direction of the photoconductive drum 1. The toner band can be formed by forming a predetermined electrostatic latent image on the photoconductive drum 1 through a charging process and an exposing process and developing the predetermined electrostatic latent image. Alternatively, the toner band may be formed without performing the exposing process (and the charging process) by transferring the toner from the developing sleeve 41 to the photoconductive drum 1 at the developing portion using the potential difference between the surface potential of the photoconductive drum 1 and the potential of the developing sleeve 41. In that case, typically, the toner band can be formed using the potential difference between the surface potential of a region of the photoconductive drum 1 that is not charged by the charge roller 2 and the potential of the developing sleeve 41 to which a developing voltage equal to that at image formation is applied.

Transfer of the toner band to the intermediate transfer belt 7 when the toner band passes through the primary transfer portion T1 can be prevented by applying a voltage of the same polarity as the regular charge polarity of the toner to the primary transfer roller 5 from the primary transfer power source E3. Alternatively, the intermediate transfer belt 7 may be separated from the photoconductive drum 1 when the toner band passes through the primary transfer portion T1.

In the present embodiment, the image forming apparatus 100 includes a counter 20 (FIG. 6) for counting an index value correlated to the amount of toner held at the cleaning portion CL after completion of image formation of the job. In the present embodiment, the counter 20 counts the number of images formed in the job as the index value and stores it. The number of images is the number of images formed. Other examples of the index value include the time of rotation of the photoconductive drum 1 and the amount of rotation of the photoconductive drum 1 in addition to the number of images formed. Still another example is a parameter correlated to them. The control unit 50 changes the amount of toner to be supplied to the cleaning portion CL during post rotation after completion of image formation of the job depending on the count value of the images counted by the counter 20. In the present embodiment, the amount of toner to be supplied to the cleaning portion CL is changed by changing the size of the toner band, in particular, the length in the conveying direction (crosswise direction). In the present embodiment, the density of the toner of the toner band (the weight of the toner per unit area [mg/cm$^2$]) is substantially constant.

In the present embodiment, this allows a necessary amount of toner for reducing the rotation load of the photoconductive drum 1 at the start-up to prevent malfunction of the cleaning blade 61 to be held at the cleaning portion CL without wastefully consuming the toner.

Figure 7:
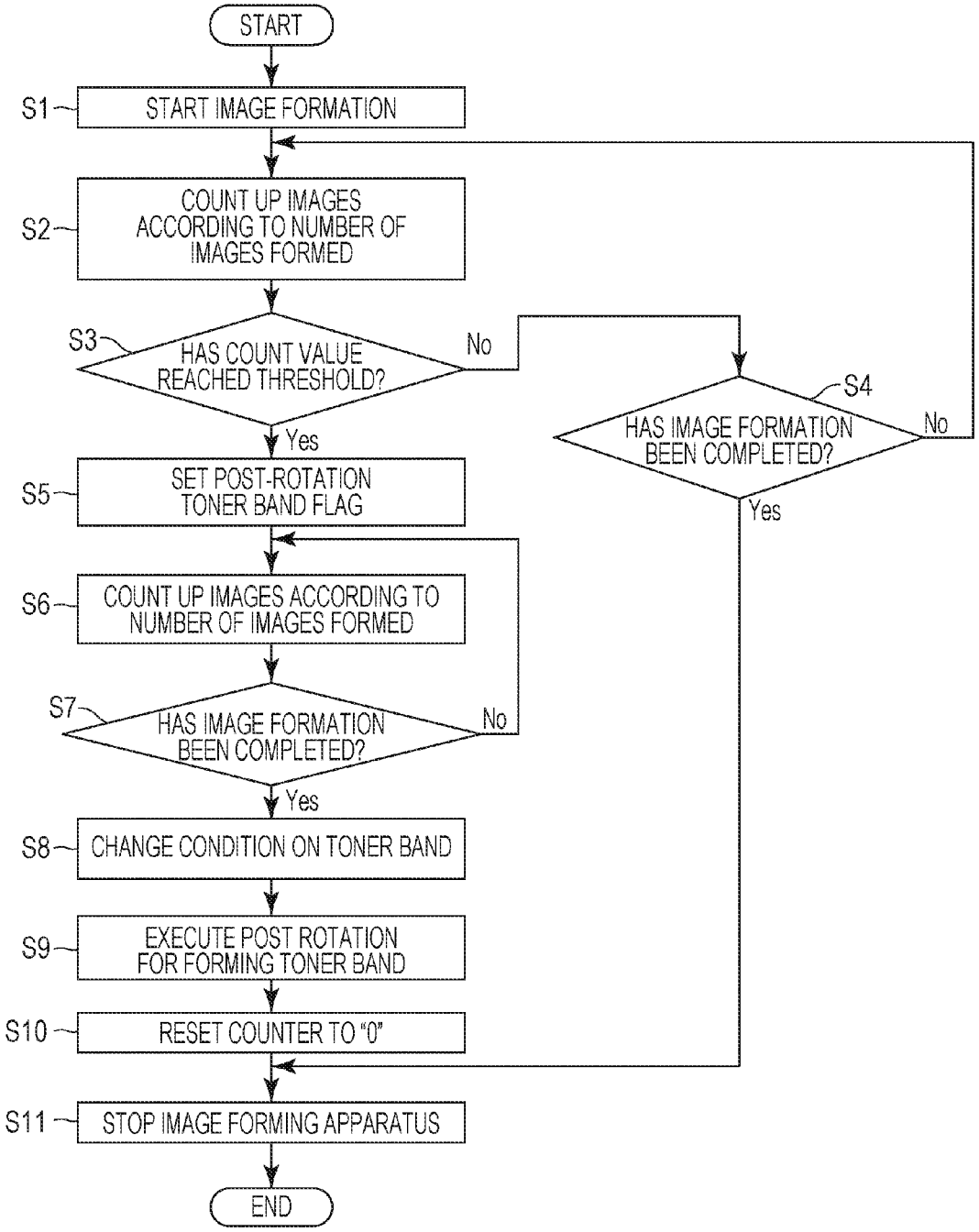
FIG. 7 is a flowchart illustrating an operation for forming a toner band.

FIG. 7 is a flowchart illustrating, in outline, the procedure of the job including the supply operation (formation of a toner band) in the present embodiment.

Upon receiving a job, the control unit 50 activates the photoconductive drum 1 and the intermediate transfer belt 7 (starts the rotation) to start the job (S1). When the job is started, the counter 20 counts up the number of images every time an image is formed (S2). In the present embodiment, the counter 20 counts the number of images in terms of A4 size (in other words, an image smaller than A4 size is counted in terms of a value less than 1, and an image larger than A4 size is counted in terms of a value larger than 1 as appropriate). The control unit 50 determines whether the count value has reached a predetermined threshold value (25 in the present embodiment) every time the count value of the counter 20 is counted up (S3). If the control unit 50 determines that the count value has not reached the threshold value (S3: No), then the control unit 50 determines whether all the images of the job have been formed (S4). If the control unit 50 determines that not all the images of the job have been formed (S4: No), then the control unit 50 returns the process to S2. In contrast, if the control unit 50 determines that all the images have been formed (S4: Yes), then the control unit 50 executes a predetermined post-rotation process that includes no supply operation and thereafter stops the rotation of the photoconductive drum 1 and the intermediate transfer belt 7 to terminate the job (S11). In other words, since a flag (described later) is not set, the control unit 50 terminates the job without executing the supply operation during the post rotation.

If at S3 the control unit 50 determines that the count value has reached the threshold value (the threshold value or greater) (S3: Yes), then the control unit 50 stores information indicating that the supply operation is to be executed during post rotation in the RAM 53, i.e., sets a flag (S5). Afterwards, image formation is performed while the counter 20 is counting up the count value (S6) until all the images of the job are formed. The control unit 50 determines whether all the images of the job have been formed (S7).

If at S7 the control unit 50 determines that all the images have been formed (S7: Yes), in which case the flag is set, the control unit 50 determines (changes) the size of the toner band to be formed in the supply operation executed during the post rotation according to the current count value (S8). A method for determining the size of the toner band in the present embodiment will be described later. Afterwards, the control unit 50 causes the image forming apparatus 100 to execute the post-rotation process including the supply operation for forming a toner band of the size determined at S8 (S9). After execution of the supply operation, the control unit 50 resets the count value of the counter 20 to 0 (S10). Thereafter, the control unit 50 stops the rotation of the photoconductive drum 1 and the intermediate transfer belt 7 to terminate the job (S11).

In the present embodiment, the count value of the counter 20 multiplied by a predetermined factor (2 mm in the present embodiment) is the length of the toner band in the conveying direction. Thus, in the present embodiment, the amount of toner of the toner band is linearly changed relative to the count value of the counter 20. For example, if the count value is 30, the length of the toner band in the conveying direction is 60 mm. If the count value is 50, the length of the toner band in the conveying direction is 100 mm.

Figure 8A:
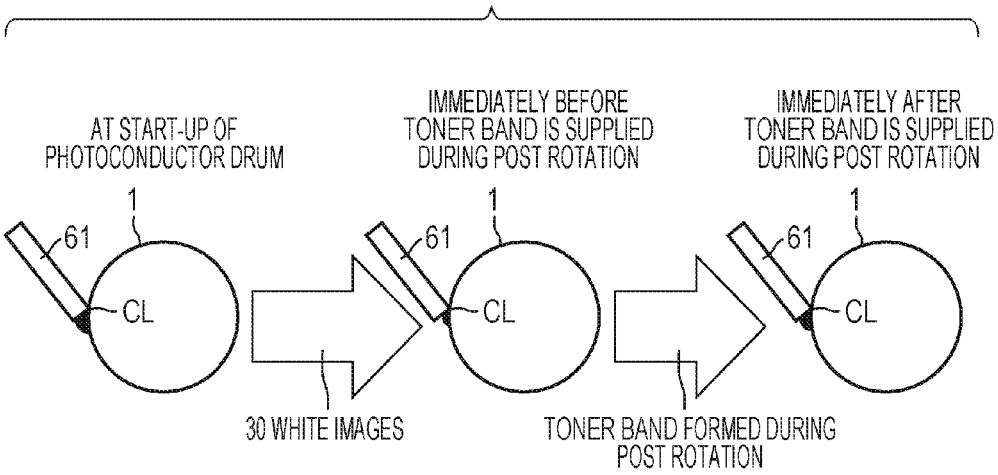
FIG. 8A is a schematic diagram illustrating the effect of the embodiment.
Figure 8B:
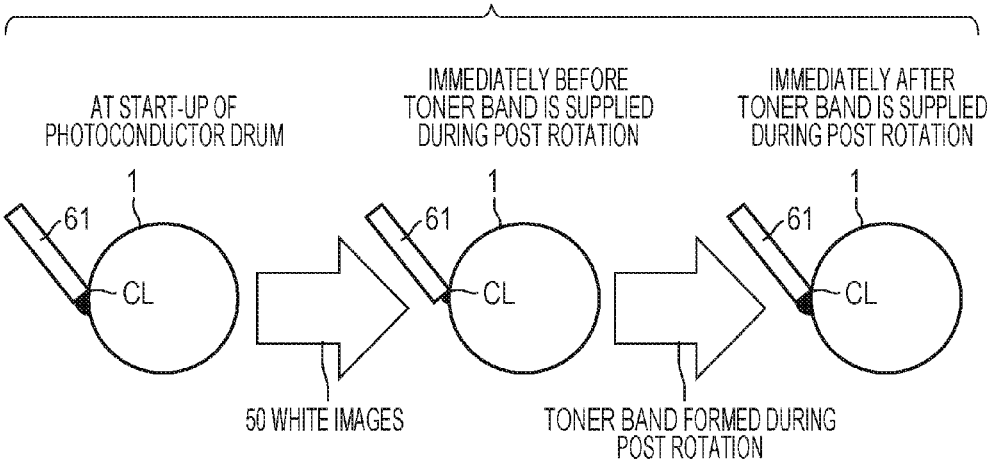
FIG. 8B is a schematic diagram illustrating the effect of the embodiment.

Referring next to FIGS. 8A and 8B, the states of the toner held at the cleaning portion CL before image formation, after image formation, and after post rotation will be described.

For example, when 30 A4-size white images (image area percentage: 0%) are continuously output, the amount of toner held at the cleaning portion CL after completion of image formation decreases from the amount of toner held before image formation, as illustrated in FIG. 8A. However, when a toner band with a length of 60 mm in the conveying direction is formed during post rotation and supplied to the cleaning portion CL, the amount of toner held at the cleaning portion CL becomes substantially the same as the amount of toner held before the image formation.

When 50 A4-size solid white images are continuously formed, the amount of toner held at the cleaning portion CL after completion of image formation is more decreased than the case of 30 images, as illustrated in FIG. 8B. However, when a toner band with a length in the conveying direction (100 mm) longer than that of the case of 30 images is formed during post rotation and supplied to the cleaning portion CL, the amount of toner held at the cleaning portion CL thereafter becomes substantially the same as the amount of toner held before the image formation.

In the present embodiment, the amount of toner of the toner band is linearly changed relative to the count value of the counter 20. This allows the amount of toner held at the cleaning portion CL at the start-up of the photoconductive drum 1 to be held substantially constant regardless of the number of images formed at the job. This reduces the rotation load at the start-up of the photoconductive drum 1 with stability to stabilize the posture of the cleaning blade 61 at the start-up of the photoconductive drum 1, preventing malfunction of the cleaning blade 61, thereby preventing cleaning failure. This also prevents more than necessary amount of toner from being held at the cleaning portion CL, reducing wasteful toner consumption.

Figure 9A:
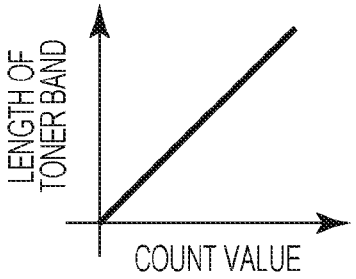
FIG. 9A is a graph illustrating an example of a method for determining the amount of toner of a toner band.
Figure 9B:
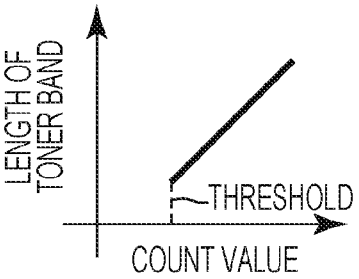
FIG. 9B is a graph illustrating an example of a method for determining the amount of toner of a toner band.

FIGS. 9A to 9D are graphs illustrating an example of a method for determining the amount of toner of the toner band. FIGS. 9A to 9D each illustrate the relationship between the count value of the counter 20 and the amount of toner of the toner band (the length of the toner band in the conveying direction). In the present embodiment, if the count value is less than a predetermined threshold value, as illustrated in FIG. 9B, the supply operation (formation of the toner band) is not executed during the post rotation, but it is to be understood that the present disclosure is not limited thereto.

For example, as illustrated in FIG. 9A, the amount of toner of the toner band may be linearly changed relative to the count value (>0) without setting a threshold value. However, when the number of images formed in the job is small, the amount of toner held at the cleaning portion CL may not decrease so much. In that case, if the supply operation is executed during post rotation, waiting time can increase, or the life of components, such as the photoconductive drum 1, can decrease. For that reason, a threshold value at which the supply operation is executed during post rotation may be set, and when the count value has reached the threshold value or greater, the amount of toner of the toner band may be linearly changed relative to the count value, as in the present embodiment.

Figure 9C:
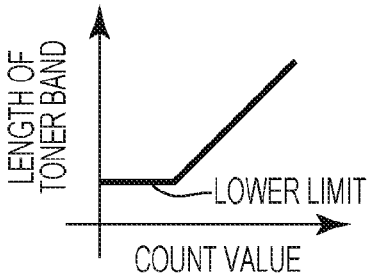
FIG. 9C is a graph illustrating an example of a method for determining the amount of toner of a toner band.

In another example, as illustrated in FIG. 9C, a lower limit may be set for the amount of toner of the toner band. This prevents, for example, when forming a toner band without executing the exposing process, forming a toner band of a size that can cause instability in the timing of switching a high voltage (a developing voltage or a charging voltage) for forming the toner band, allowing a stable toner band to be formed.

Figure 9D:
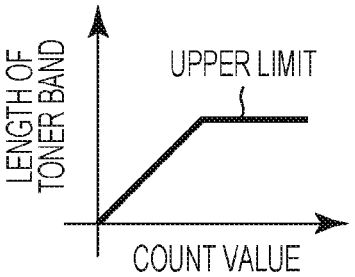
FIG. 9D is a graph illustrating an example of a method for determining the amount of toner of a toner band.

When the number of images formed at the job is large, the amount of toner held at the cleaning portion CL may not decrease to a certain amount or less. In that case, linearly increasing the amount of toner of the toner band relative to the count value will increase wasteful toner. For that reason, as illustrated in FIG. 9D, an upper limit may be set for the amount of toner of the toner band.

Setting both of the upper limit and the lower limit will more stabilize the posture of the cleaning blade 61 at the start-up of the photoconductive drum 1 without wastage. The threshold value may be set in addition to at least one of the upper limit and the lower limit.

In the present embodiment, the size of the toner band is changed by changing the length of the toner band in the conveying direction. Instead or in addition, the length of the toner band in a direction substantially perpendicular to the conveying direction may be changed. Alternatively, the toner band may be divided into a plurality of pieces in at least one of the conveying direction and the direction substantially perpendicular to the conveying direction, and the entire length in the direction may be changed.

As described above, the image forming apparatus 100 of the present embodiment includes the control unit 50 that causes the image forming apparatus 100 to execute the supply operation for supplying the toner supplied from the developing unit 4 to the photoconductive drum 1 to the cleaning portion CL after completion of image formation and before the rotation of the photoconductive drum 1 stops. The image forming apparatus 100 also includes the counter 20 for counting an index value correlated to the number of images formed in image formation. The control unit 50 changes the amount of toner to be supplied to the cleaning portion CL in the supply operation on the basis of the index value counted by the counter 20. In the present embodiment, the control unit 50 linearly changes the amount of toner to be supplied to the cleaning portion CL in the supply operation relative to the index value. In the present embodiment, the index value is a value that increases with an increase in the number of images formed in image formation, and the control unit 50 supplies a larger amount of toner to the cleaning portion CL in a supply operation in a case where the index value is a second value larger than a first value. The control unit 50 may not execute the supply operation when the index value is less than a predetermined threshold value. When the index value is less than a predetermined lower limit, the control unit 50 can set the amount of toner to be supplied to the cleaning portion CL in the supply operation constant at the predetermined lower limit. When the index value is greater than a predetermined upper limit, the control unit 50 can set the amount of toner to be supplied to the cleaning portion CL in the supply operation constant at the predetermined upper limit. In particular, in the present embodiment, the control unit 50 changes the amount of toner to be supplied to the cleaning portion CL in the supply operation by changing the size of the toner image (toner band) to be formed on the photoconductive drum 1 in the supply operation.

As described above, in the present embodiment, the amount of toner of the toner band to be formed in the supply operation executed during the post rotation is changed depending on the count value of the counter 20. This prevents the malfunction of the cleaning blade 61 by reducing rotation load at the start-up of the photoconductive drum 1 while reducing wasteful consumption of the toner, thereby stabilizing the posture of the cleaning blade 61.

Second Embodiment

Next, another embodiment of the present disclosure will be described. The basic configuration and operation of the image forming apparatus of the present embodiment are the same as those of the first embodiment. For that reason, components of the image forming apparatus of the present embodiment having the same or corresponding function or configuration as those of the image forming apparatus of the first embodiment are given the same reference signs, and detailed descriptions will be omitted.

In the present embodiment, the amount of toner of the toner band is changed in a stepwise manner relative to the count value of the counter 20. Also in the present embodiment, the amount of toner of the toner band is changed by changing the length of the toner band in the conveying direction, as in the first embodiment.

Figure 10A:
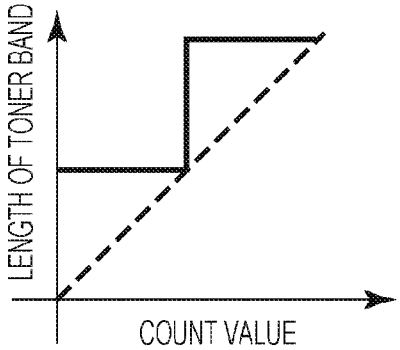
FIG. 10A is a graph illustrating another example of a method for determining the amount of toner of a toner band.
Figure 10B:
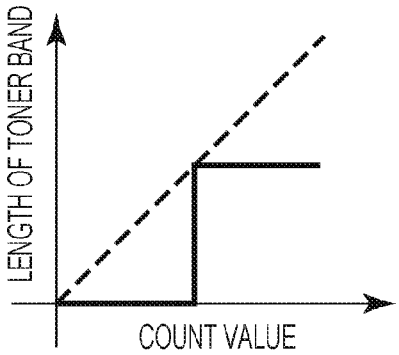
FIG. 10B is a graph illustrating another example of a method for determining the amount of toner of a toner band.
Figure 10C:
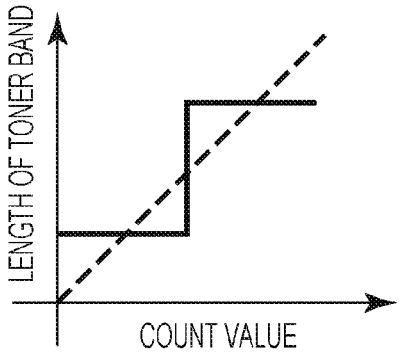
FIG. 10C is a graph illustrating another example of a method for determining the amount of toner of a toner band.

FIGS. 10A to 10C are graphs illustrating an example of a method for determining the amount of toner of the toner band in the present embodiment. FIG. 10A to AC each illustrate the relationship between the count value of the counter 20 and the amount of toner of the toner band (the length of the toner band in the conveying direction). FIGS. 10A to 10C also illustrate a case in which the amount of toner of the toner band is linearly changed, as in the first embodiment.

Setting the amount of toner of the toner band larger than that in the case of linear change, as illustrated in FIG. 10A, more reliably prevents the posture of the cleaning blade 61 from becoming unstable. However, this may supply more than necessary amount of toner to the cleaning portion CL. Conversely, setting the amount of toner of the toner band smaller than that in the case of linear change, as illustrated in FIG. 10B, prevents more than necessary amount of toner from being supplied to the cleaning portion CL. However, in that case, the decrease in the amount of toner of the toner band may make the posture of the cleaning blade 61 unstable. For that reason, as illustrated in FIG. 10C, the amount of toner of the toner band may be changed in a stepwise manner in such a manner as to straddle (typically, to come to substantially the center of) the relationship between the count value and the amount of toner of the toner band in the case of linear change. This allows a good balance between the amount of toner consumed in the supply operation and the posture of the cleaning blade 61.

Also when the amount of toner of the toner band is changed in a stepwise manner, the threshold value and the upper and lower limits of the amount of toner of the toner band can be set, as in the first embodiment.

As described above, in the present embodiment, the control unit 50 changes the amount of toner to be supplied to the cleaning portion CL in the supply operation in a stepwise manner relative to the index value. Changing the amount of toner of the toner band in a stepwise manner as in the present embodiment simplifies the sequence of the process of determining the amount of toner of the toner band as compared with the case of linear change of the first embodiment. Sufficiently increasing the steps at which the amount of toner of the toner band is changed will approximate to the case of linear change and stabilize the posture of the cleaning blade 61 at the start-up of the photoconductive drum 1 while preventing wasteful consumption of toner.

Third Embodiment

Next, still another embodiment of the present disclosure will be described. The basic configuration and operation of the image forming apparatus of the present embodiment are the same as those of the first and second embodiments. For that reason, components of the image forming apparatus of the present embodiment having the same or corresponding function or configuration as those of the image forming apparatuses of the first and second embodiments are given the same reference signs, and detailed descriptions will be omitted.

In the first and second embodiments, the amount of toner of the toner band is changed by changing the length of the toner band in the conveying direction. In contrast, in the present embodiment, the amount of toner of the toner band is changed by changing the density (the weight of toner per unit area [mg/cm$^2$]). In other words, in the present embodiment, the control unit 50 changes the amount of toner to be supplied to the cleaning portion CL in the supply operation by changing the density of the toner image (toner band) to be formed on the photoconductive drum 1 in the supply operation.

Figure 11A:
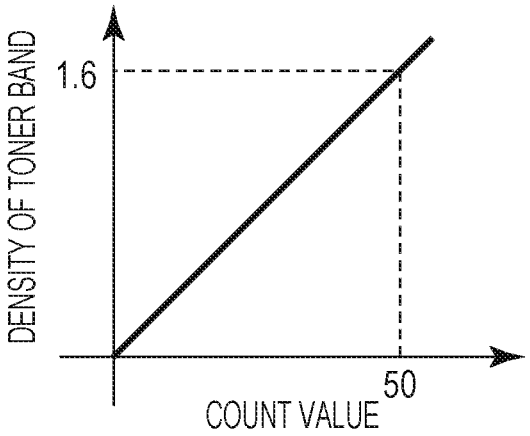
FIG. 11A is a graph illustrating still another example of a method for determining the amount of toner of a toner band.
Figure 11B:
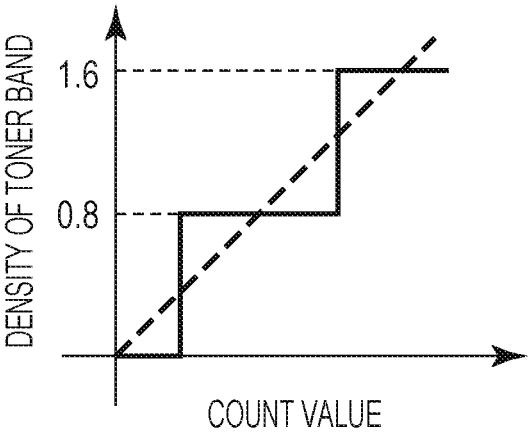
FIG. 11B is a graph illustrating still another example of a method for determining the amount of toner of a toner band.

FIGS. 11A and 11B are graphs illustrating an example of a method for determining the amount of toner of the toner band in the present embodiment and each illustrate the relationship between the count value of the counter 20 and the density (optical density) of the toner band. As illustrated in FIG. 11A, when the upper limit of the density of the toner band on the printing medium P is 1.6, the density of the toner band can be linearly changed relative to the count value of the counter 20 by dividing the value 1.6 by the count value. However, linearly changing the density of the toner band causes a subtle density difference, possibly hindering stable control of the density of the toner band. For that reason, the density of the toner band is changed in a stepwise manner, as illustrated in FIG. 11B. This enables the density of the toner band to be stably controlled according to the count value.

FIGS. 11A and 11B illustrate the density of the toner band in terms of the optical density of the toner band on the printing medium P when the toner band is transferred onto the printing medium P through primary transfer and secondary transfer. The density of the toner band can be controlled using any index that enables control of the amount of toner to be supplied to the cleaning portion CL. Examples of the index include the optical density of a toner band on the photoconductive drum 1, the optical density of a toner band on the intermediate transfer belt 7, or more directly, the weight (placement amount) of the toner on the photoconductive drum 1 per unit area [mg/cm$^2$].

A method for changing the density of the toner band may be freely selected. The density of the toner band can be changed by changing at least one of the exposure amount (laser power) of the exposure unit 3, the charging voltage, the developing voltage, and the transfer voltage. In other words, in forming the toner band by executing the exposing process, the exposure amount of the exposure unit 3 is changed. In forming the toner band without executing exposure performed by the exposure unit 3, the potential difference between the surface potential of the photoconductive drum 1 and the potential of the developing sleeve 41 is changed by changing at least one of the charging voltage and the developing voltage. Alternatively, the density of the toner band to be supplied to the cleaning portion CL through the primary transfer portion T1 can be changed by changing a voltage to be applied to the primary transfer roller 5 to change the amount of toner to be transferred to the intermediate transfer belt 7.

Also when the density of the toner band is changed, the threshold value and the upper and lower limits of the amount of toner of the toner band can be set, as in the first and second embodiments.

Alternatively, the amount of toner of the toner band can be changed also by changing both of the size and the density of the toner band.

Other Embodiments

Having described the present disclosure based on specific embodiments, it is to be understood that the present disclosure is not limited to the above embodiments.

In the above embodiments, the counter counts the number of images formed in the job. In other words, as described above, the amount of toner held at the cleaning portion at the completion of the job tends to decrease as the running distance of the photoconductive drum in the job increases. Therefore, the number of images formed in the job may be counted as an index value that increases with an increase in the running distance of the photoconductive drum. This gives sufficient effects with relatively simple control. However, the amount of toner held at the cleaning portion at the completion of the job can also be changed depending on the amount of toner formed at the job. In other words, the amount of toner held at the cleaning portion at the completion of the job tends to increase as the amount of toner formed in the job increases. Therefore, the amount of toner of the toner band may be changed in consideration of the amount of images formed in the job, typically, the image area percentage (coverage rate). For example, a reference image area percentage is set, and images of this image area percentage (either a predetermined value or values within a predetermined range) are added up in terms of a value 1. Images of an image area percentage lower than the reference are added up in terms of a value greater than 1 as appropriate, and images of an image area percentage higher than the reference are added up in terms of a value less than 1 as appropriate. That is to say, the number of images can be cumulated, with the images weighted by the image area percentage. In other words, the control unit can change the amount of toner to be supplied to a contact portion between the cleaning member and the image bearing member in the supply operation on the basis of the coverage rate of each image formed in image formation. This allows a sufficient amount of toner to be supplied to the cleaning portion depending on the running distance of the photoconductive drum and the amount of toner of the image while preventing wasteful consumption of toner. Furthermore, the index value can be counted in consideration of any factors that influence the amount of toner held at the cleaning portion after completion of image formation of the job. If the amount of toner consumed in image formation is large, the index value may be below zero. In such a case, if the integrated value of the index values is below zero, the index values are not added up.

Furthermore, toner can be supplied to the cleaning portion by forming a toner band regularly at the inter-sheet process (for example, every time a predetermined number of images are formed) during execution of the job of continuous image formation. This prevents the toner held at the cleaning portion from running dry during continuous image formation to cause malfunction of the cleaning blade. Also in that case, the toner band can be formed during post rotation with the same control as in the above embodiments. When the toner band is formed at the inter-sheet process, the count value of the counter may be subtracted (for example, reset to 0 once).

Although the present disclosure is particularly useful in the case where the cleaning member is a cleaning blade, the present disclosure is not limited thereto. The above advantageous effect can be expected by applying the present disclosure to any cleaning member that is in contact with an image bearing member to clean the image bearing member and that can malfunction at the start-up of the image bearing member due to a decrease in the amount of toner held at the contact with the image bearing member. Other examples of the cleaning member include a block-like (pad-like) member and a sheet-like member which are in contact with the image bearing member.

Although the above embodiments have been described as applied to the configuration of a cleaning member that cleans a photoconductive member, it is to be understood that the present disclosure is not limited to such embodiments. Any cleaning member that is in contact with an image bearing member that bears a toner image to clean the image bearing member can have the same effects as in the above embodiments by applying the present disclosure. For example, the present disclosure may be applied to the configuration of a cleaning member that cleans another image bearing member, such as an intermediate transfer member. In that case, a predetermined toner image formed by the image forming unit (either a single image forming unit or a plurality of image forming units) serving as a supply unit is transferred to the intermediate transfer member, and the toner of the toner image can be supplied to a contact portion between the intermediate transfer member and the cleaning member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-138021 filed Jul. 12, 2016, which is hereby incorporated by reference herein in its entirety.

What is claimed is:

1. An image forming apparatus comprising:

a rotatable photoconductive member on which an electrostatic image is formed based on an image signal;

a developing unit configured to apply toner to the electrostatic image formed on the photoconductive member;

a cleaning blade that is in contact with the photoconductive member to form a nip portion and that is configured to remove an adhering substance adhering to the photoconductive member as the photoconductive member moves; and an execution unit configured to execute a supply operation of forming a supply toner on the photoconductive member to supply the supply toner to the nip portion after completion of an image forming job of forming an image on one or a plurality of printing media in a series of operations and before the photoconductive member stops rotation, wherein the execution unit sets the amount of supply toner such that the amount of supply toner linearly increases with an increase in the number of images formed at the image forming job.

2. The image forming apparatus according to claim 1, wherein, when the number of images formed at the image forming job is less than a predetermined threshold value, the execution unit does not execute the supply operation.

3. The image forming apparatus according to claim 1, wherein, when the number of images formed at the image forming job is less than a predetermined lower limit, the execution unit sets the amount of supply toner to a certain lower limit.

4. The image forming apparatus according to claim 1, wherein, when the number of images formed at the image forming job is greater than a predetermined upper limit, the execution unit sets the amount of supply toner to a certain upper limit.

5. The image forming apparatus according to claim 1, wherein the execution unit changes the amount of supply toner by changing a length of the supply toner in a direction of movement of the photoconductive member.

6. The image forming apparatus according to claim 1, wherein the execution unit changes the amount of supply toner by changing a weight of toner per unit area.

7. An image forming apparatus comprising:

a rotatable photoconductive member on which an electrostatic image is formed based on an image signal;

a developing unit configured to apply toner to the electrostatic image formed on the photoconductive member;

a cleaning blade that is in contact with the photoconductive member to form a nip portion and that is configured to remove an adhering substance adhering to the photoconductive member as the photoconductive member moves; and an execution unit configured to execute a supply operation of forming a supply toner on the photoconductive member to supply the supply toner to the nip portion after completion of an image forming job of forming an image on one or a plurality of printing media in a series of operations and before the photoconductive member stops rotation, wherein the execution unit sets the amount of supply toner such that the number of images formed at the image forming job and the amount of supply toner have a stepwise relationship.

8. The image forming apparatus according to claim 7, wherein the execution unit sets the amount of supply toner when the number of images is a first value to be larger than the amount of supply toner when the number of images is a second value less than the first value.

9. The image forming apparatus according to claim 8, wherein, when the number of images formed at the image forming job is less than a predetermined threshold value, the execution unit does not execute the supply operation.

10. The image forming apparatus according to claim 8, wherein, when the number of images formed at the image forming job is less than a predetermined lower limit, the execution unit sets the amount of supply toner to a certain lower limit.

11. The image forming apparatus according to claim 8, wherein, when the number of images formed at the image forming job is greater than a predetermined upper limit, the execution unit sets the amount of supply toner to a certain upper limit.

12. The image forming apparatus according to claim 8, wherein the execution unit changes the amount of supply toner by changing a length of the supply toner in a direction of movement of the photoconductive member.

13. The image forming apparatus according to claim 8, wherein the execution unit changes the amount of supply toner by changing a weight of toner per unit area.

* * * * *